US005244860A

United States Patent [19]

Graf et al.

[11] Patent Number: 5,244,860

[45] Date of Patent: * Sep. 14, 1993

[54] PRESSURE-SENSITIVE RECORDING AND TRANSFER MATERIAL

[75] Inventors: René Graf, Muttenz; Werner Mischler, Mariastein; Peter Burri, Bottmingen, all of Switzerland

[73] Assignee: Ciba-Geigy Corporation, Ardsley, N.Y.

[ * ] Notice: The portion of the term of this patent subsequent to Jun. 18, 2008 has been disclaimed.

[21] Appl. No.: 702,985

[22] Filed: May 20, 1991

[30] Foreign Application Priority Data

May 29, 1990 [CH] Switzerland ..... 1812/90

[51] Int. Cl.[5] ..... B41M 5/136

[52] U.S. Cl. ..... 503/212; 427/151; 503/217; 503/218; 503/220; 503/223

[58] Field of Search ..... 427/151; 503/217, 220, 503/223, 224, 212, 218

[56] References Cited

U.S. PATENT DOCUMENTS

| | | | |
|---|---|---|---|
| 4,587,539 | 5/1986 | Bedekovic et al. | 346/220 |
| 4,688,059 | 8/1987 | Schmidt et al. | 503/220 |
| 5,024,988 | 6/1991 | Zink et al. | 503/212 |

FOREIGN PATENT DOCUMENTS

| | | | |
|---|---|---|---|
| 0082822 | 6/1983 | European Pat. Off. | 503/220 |
| 0373110 | 6/1990 | European Pat. Off. | 503/220 |

OTHER PUBLICATIONS

J. Amer. Chem. Soc 38, 2101-2119 (1916).
Hevitica Chim. Acta, 1058-1100 (1959).

*Primary Examiner*—Pamela R. Schwartz

*Attorney, Agent, or Firm*—George R. Dohmann

[57] ABSTRACT

There is described a pressure-sensitive recording and transfer material containing in a first sheet a coating comprising one of the components (A) and (B) or a solvent for these components and in a second sheet the other or both of the components (A) and (B) and an electron-attracting and colour-developing material as component (C), (A) being a polycyclic compound of the formula

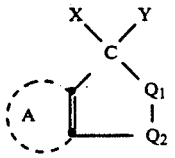

(1)

where X is a monocyclic or polycyclic aromatic or heteroaromatic radical, Y is a substituent which is detachable as an anion, $Q_1$ is —O—, —S—,

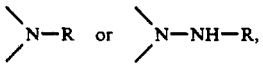

$Q_2$ is $—CH_2—$, —CO—, —CS— or $—SO_2—$, R is hydrogen, $C_1$-$C_{12}$alkyl, $C_5$-$C_{10}$cycloalkyl, aryl, such as phenyl, or aralkyl, such as benzyl, and the ring A, which may be substituted, is an aromatic or heterocyclic radical of 6 ring atoms with or without a fused aromatic ring which may likewise be substituted, and (B) being an organic condensation component.

34 Claims, No Drawings

PRESSURE-SENSITIVE RECORDING AND TRANSFER MATERIAL

The present invention provides a pressure-sensitive recording and transfer material containing in a first sheet a coating comprising one of the components (A) and (B) or a solvent for these components and in a second sheet the other or both of the components (A) and (B) and an electron-attracting and colour-developing material as component (C), (A) being a polycyclic compound of the formula

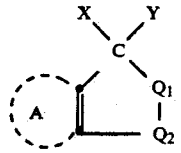

(1)

where X is a monocyclic or polycyclic aromatic or heteroaromatic radical, Y is a substituent which is detachable as an anion, $Q_1$ is —O—, —S—,

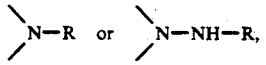

$Q_2$ is $—CH_2—$, —CO—, —CS— or $—SO_2—$, R is hydrogen, $C_1$–$C_{12}$alkyl, $C_5$–$C_{10}$cycloalkyl, aryl, such as phenyl, or aralkyl, such as benzyl, and the ring A, which may be substituted, is an aromatic or heterocyclic radical of 6 ring atoms with or without a fused aromatic ring which may likewise be substituted, and (B) being an organic condensation component.

When pressure is exerted, components (A), (B) and (C) come into contact with one another and leave marks behind on the developer sheet. The colour produced depends on the nature of components (A) and (B), which represent the electron donor and form the chromogenic part. The process of colour formation is caused by component (C). By combining the individual components in an appropriate manner it is thus possible to produce the desired colours, for example yellow, orange, red, violet, blue, green, grey, black or mixed colours. A further possibility is to use components (A) and (B) together with one or more conventional colour formers, e.g. 3,3-(bisaminophenyl)phthalides such as CVL, 3-indolyl-3-aminophenylaza- or -diaza-phthalides, (3,3-bisindolyl)phthalides, 3-aminofluorans, 6-dialkylamino-2-dibenzylaminofluorans, 6-dialkylamino-3-methyl-2-arylaminofluorans, 3,6-bisalkoxyfluorans, 3,6-bisdiarylaminofluorans, leucoauramines, spiropyrans, spirodipyrans, benzoxazines, chromenopyrazoles, chromenoindoles, phenoxazines, phenothiazines, quinazolines, rhodaminelactams, carbazolylmethanes or further triarylmethane leuco dyes.

The compounds of the formula (1) (component (A)) contain as part of their structure for example the basic skeleton of a lactone, lactam, sultone, sultam or phthalan, and these basic skeletons are subject before, during or after the reaction of component (A) with the condensation component (B) to a ring opening or bond cleaving reaction on contact with the colour developer (component (C)), the type of reaction which is also suspected to take place in the prior art recording materials.

In the formula (1) the heteroaromatic radical X is advantageously bonded to the central (meso) carbon atom of the polycyclic compound via a carbon atom of the hetero ring.

Hetaryl X is for example thienyl, acridinyl, benzofuranyl, benzothienyl, naphthothienyl or phenothiazinyl, but advantageously pyrrolyl, indolyl, carbazolyl, julolidinyl, kairolinyl, indolinyl, dihydroquinolinyl or tetrahydroquinolinyl.

The monocyclic or polycyclic heteroaromatic radical may be monosubstituted or poly-substituted in the ring. Suitable carbon substituents are for example halogen, hydroxyl, cyano, nitro, lower alkyl, lower alkoxy, lower alkylthio, lower alkoxycarbonyl, acyl of 1 to 8 carbon atoms, preferably lower alkylcarbonyl, amino, lower alkylamino, lower alkylcarbonylamino or di(-lower alkyl)amino, $C_5$–$C_6$cycloalkyl, benzyl or phenyl, while nitrogen substituents are for example $C_1$–$C_{12}$alkyl, $C_2$–$C_{12}$alkenyl, $C_5$–$C_{10}$cycloalkyl, $C_1$–$C_8$acyl, phenyl, benzyl, phenethyl or phenisopropyl, which may each be substituted for example by cyano, halogen, nitro, hydroxyl, lower alkyl, lower alkoxy, lower alkylamino or lower alkoxycarbonyl.

The alkyl and alkenyl radicals can be straight-chain or branched. Examples thereof are methyl, ethyl, n-propyl, isopropyl, n-butyl, 1-methylbutyl, t-butyl, sec-butyl, amyl, isopentyl, n-hexyl, 2-ethylhexyl, isooctyl, n-octyl, 1,1,3,3-tetramethylbutyl, nonyl, isononyl, 3-ethylheptyl, decyl and n-dodecyl on the one hand and vinyl, allyl, 2-methylallyl, 3-ethylallyl, 2-butenyl and octenyl on the other.

Acyl is in particular formyl, lower alkylcarbonyl, e.g. acetyl or propionyl, or benzoyl. Further possible acyl is lower alkylsulfonyl, e.g. methylsulfonyl or ethylsulfonyl, or phenylsulfonyl. Benzoyl and phenylsulfonyl may be substituted by halogen, methyl, methoxy or ethoxy.

Lower alkyl, lower alkoxy and lower alkylthio are groups or group constituents that have from 1 to 6, in particular 1 to 3, carbon atoms. Examples of such groups are methyl, ethyl, n-propyl, isopropyl, n-butyl, sec-butyl, tert-butyl, amyl, isoamyl and hexyl, methoxy, ethoxy, isopropoxy, isobutoxy, tert-butoxy and amyloxy, and methylthio, ethylthio, propylthio and butylthio.

Halogen is for example fluorine, bromine or preferably chlorine.

Preferred heteroaromatic radicals are substituted 2- or 3-pyrrolyl radicals or in particular 3-indolyl radicals, e.g. N—$C_1$–$C_8$alkyl-2-pyrrolyl, N-phenyl-3-pyrrolyl, 2-methyl-3-indolyl, N—$C_1$–$C_8$alkyl-2-methyl-3-indolyl, N—$C_2$–$C_4$alkanoyl-2-methyl-3-indolyl, 2-phenyl-3-indolyl or N—$C_1$–$C_8$alkyl-2-phenyl-3-indolyl.

Aryl X can be unsubstituted or halogen-, cyano-, lower alkyl-, $C_5$–$C_6$cycloalkyl-, $C_1$–$C_8$-acyl-, $R_2R_1N$—, $R_3O$— or $R_3S$-substituted phenyl or naphthyl.

Aryl X is preferably a substituted phenyl radical of the formula

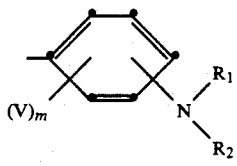

(1a)

or

-continued

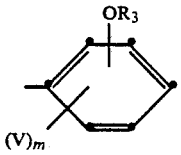

(1b)

In these formulae, $R_1$, $R_2$ and $R_3$ are each independently of the others hydrogen, unsubstituted or halogen-, hydroxyl-, cyano- or lower alkoxy-substituted alkyl of not more than 12 carbon atoms, acyl of from 1 to 8 carbon atoms, cycloalkyl of from 5 to 10 carbon atoms or unsubstituted or halogen-, trifluoromethyl-, cyano-, lower alkyl-, lower alkoxy-, lower alkoxycarbonyl-, X"X'N— or 4—NX'X"-phenylamino-ring-substituted phenylalkyl or phenyl, where X' and X" are each independently of the other hydrogen, lower alkyl, cyclohexyl, benzyl or phenyl, or $R_1$ and $R_2$ together with the nitrogen atom joining them together are a five- or six-membered, preferably saturated, heterocyclic radical. V is hydrogen, halogen, lower alkyl, $C_1$–$C_{12}$alkoxy, $C_1$–$C_{12}$acyloxy, benzyl, phenyl, benzyloxy, phenyloxy, halogen-, cyano-, lower alkyl- or lower alkoxy-substituted benzyl or benzyloxy, or the group —$NT_1T_2$. $T_1$ and $T_2$ are each independently of the other hydrogen, lower alkyl, $C_5$–$C_{10}$lower alkyl, unsubstituted or halogen-, cyano-, lower alkyl- or lower alkoxy-substituted benzyl or acyl of from 1 to 8 carbon atoms, or else $T_1$ is unsubstituted or halogen-, cyano-, lower alkyl- or lower alkoxy-substituted phenyl. m is 1 or 2. —$NR_1R_2$ and —$OR_3$ are each preferably para to the attachment point. One V is preferably ortho to the attachment point.

Alkyls R, $R_1$, $R_2$ and $R_3$ are for example the substituents mentioned above for alkyl radicals.

Substituted alkyl $R_1$, $R_2$ or $R_3$ is in particular cyanoalkyl, haloalkyl, hydroxyalkyl or alkoxyalkyl, each preferably of from 2 to 8 carbon atoms in total, e.g. 2-cyanoethyl, 2-chloroethyl, 2-hydroxyethyl, 2-methoxyethyl, 2-ethoxyethyl, 2,3-dihydroxypropyl, 2-hydroxy-3-chloropropyl, 3-methoxypropyl, 4-methoxybutyl or 4-propoxybutyl.

Examples of cycloalkyls R, $R_1$, $R_2$, $R_3$, $T_1$ and $T_2$ are cyclopentyl, cycloheptyl and preferably cyclohexyl. The cycloalkyl radicals may contain one or more $C_1$–$C_4$alkyl radicals, preferably methyl groups, and have in total from 5 to 10 carbon atoms.

Aralkyls and phenylalkyls R, $R_1$, $R_2$ and $R_3$ can be phenethyl, phenylisopropyl or in particular benzyl.

Preferred substituents in phenalkyl or phenyl R are for example halogen, cyano, methyl, trifluoromethyl, methoxy and carbomethoxy. Examples of such araliphatic and aromatic radicals are methylbenzyl, 2,4- or 2,5-dimethylbenzyl, chlorobenzyl, dichlorobenzyl, cyanobenzyl, tolyl, xylyl, chlorophenyl, methoxyphenyl, 2,6-dimethylphenyl, trifluoromethylphenyl and carbomethoxyphenyl.

The acyloxy radical in V is for example formyloxy, lower alkylcarbonyloxy, e.g. acetyloxy or propionyloxy, or benzoyloxy. $C_1$–$C_{12}$Alkoxy V can be a straight-chain or branched group, e.g. methoxy, ethoxy, isopropoxy, n-butoxy, tert-butoxy, amyloxy, 1,1,3,3-tetramethylbutoxy, n-hexyloxy, n-octyloxy or dodecyloxy.

When the pair of substituents $R_1$ and $R_2$ combines with the common nitrogen atom to form a heterocyclic radical, it may be for example pyrrolidino, piperidino, pipecolino, morpholino, thiomorpholino, piperazino, N-alkylpiperazino, e.g. N-methylpiperazino, N-phenylpiperazino or N-alkylimidazolino. Preferred saturated heterocyclic radicals for —$NR_1R_2$ are pyrrolidino, piperidino and morpholino.

The substituents $R_1$ and $R_2$ are preferably cyclohexyl, benzyl, phenethyl, cyano(lower alkyl), e.g. β-cyanoethyl, or primarily lower alkyl, e.g. methyl, ethyl or n-butyl. Preferred —$NR_1R_2$ also includes pyrrolidinyl. $R_3$ is preferably lower alkyl or benzyl.

V can advantageously be hydrogen, halogen, lower alkyl, e.g. methyl, benzyloxy, $C_1$–$C_8$-alkoxy, primarily lower alkoxy, e.g. methoxy, ethoxy, isopropoxy or tert-butoxy, or the group —$NT_1T_2$, where one of $T_1$ and $T_2$ is preferably $C_1$–$C_8$acyl or lower alkyl and the other is hydrogen or lower alkyl. The acyl radical is in this case in particular lower alkylcarbonyl, e.g. acetyl or propionyl. Preferably V is acetylamino, dimethylamino, diethylamino, benzyloxy or in particular lower alkoxy, especially ethoxy, or hydrogen.

Substituents within the meaning of Y are readily detachable substituents on the central (meso) carbon atom which turn into an anion on detachment. Substituents of this type can be halogen atoms, aliphatic, cycloaliphatic, araliphatic, aromatic or heterocyclic ether groups, e.g. alkoxy, hetaryloxy, aryloxy, cycloalkoxy or aralkoxy, or in particular acyloxy groups which conform for example to the formula $$R'—(NH—)_{n-1}—Q'—O— \quad (1c)$$

where R' is an organic radical, preferably substituted or unsubstituted $C_1$–$C_{22}$alkyl, aryl, cycloalkyl, aralkyl or hetaryl, Q' is —CO— or —$SO_2$— and n is 1 or 2, preferably 1. Examples of acyloxy are acetyloxy, propionyloxy, chloroacetyloxy, trimethylacetyloxy, benzoyloxy, methylsulfonyloxy, ethylsulfonyloxy, chloroethylsulfonyloxy, trifluoromethylsulfonyloxy, 2-chloroethylsulfonylacetyloxy, phenylsulfonyloxy, tolylsulfonyloxy, ethylaminocarbonyloxy and phenylaminocarbonyloxy.

Y is preferably an acyloxy group of the formula R"—CO—O—, where R" is lower alkyl or phenyl.

$Q_1$ is preferably an oxygen atom, while $Q_2$ is preferably —$SO_2$— or in particular —CO. If $Q_1$ is

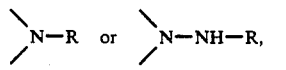

R is preferably hydrogen, methyl or phenyl.

A 6-membered aromatic ring A is preferably a benzene ring which may be substituted by halogen, cyano, nitro, lower alkyl, lower alkoxy, lower alkylthio, lower alkylcarbonyl, lower alkoxycarbonyl, amino, lower alkylamino, di(lower alkyl)amino or lower alkylcarbonylamino. A 6-membered heterocyclic ring A is in particular a nitrogen-containing heterocycle of aromatic character, e.g. a pyridine or pyrazine ring. The ring A may also contain a fused aromatic ring, preferably a benzene ring, and thus constitute for example a naphthalene, quinoline or quinoxaline ring.

The preferred 6-membered aromatic or heterocyclic radicals for A are the 2,3-pyridino, 3,4-pyridino, 2,3-pyrazino, 2,3-quinoxalino, 1,2-naphthalino, 2,3-naphthalino or 1,2-benzo radical which may be substituted by halogen, such as chlorine or bromine, nitro, lower alkyl, lower alkoxy, lower alkylthio or one of the substituted or unsubstituted amino groups defined above, an unsubstituted or halogen-substituted, in particular chlorine-tetrasubstituted, 1,2-benzo radical being particularly preferred.

Particularly important components (A) for the colour reactant system of the present invention conform to the formula

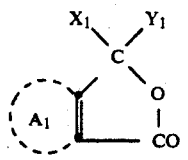

(2)

where $A_1$ is an unsubstituted or halogen-, cyano-, lower alkyl-, lower alkoxy- or di(lower alkyl)amino-substituted benzene or pyridine ring, $Y_1$ is halogen, acyloxy or in particular lower alkylcarbonyloxy or benzoyloxy and $X_1$ is a 3-indolyl radical of the formula

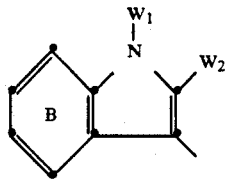

(2a)

or a substituted phenyl radical of the formula

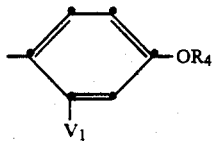

(2b)

or

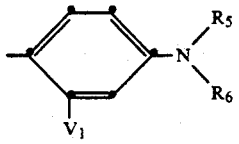

(2c)

where $W_1$ is hydrogen, unsubstituted or cyano- or lower alkoxy-substituted $C_1$–$C_8$alkyl, acetyl, propionyl or benzyl, $W_2$ is hydrogen, lower alkyl, especially methyl, or phenyl, $R_4$, $R_5$ and $R_6$ are each independently of the others unsubstituted or hydroxyl-, cyano- or lower alkoxy-substituted alkyl of not more than 12 carbon atoms, $C_5$–$C_6$cycloalkyl, benzyl, phenethyl or phenyl, or ($R_5$ and $R_6$) together with the nitrogen atom joining them together are pyrrolidino, piperidino or morpholino, $V_1$ is hydrogen, halogen, lower alkyl, $C_1$–$C_8$alkoxy, benzyloxy or the group —$NT_3T_4$, $T_3$ and $T_4$ are each independently of the other hydrogen, lower alkyl, lower alkylcarbonyl or unsubstituted or halogeno-, methyl- or methoxy-substituted benzoyl, and the ring B may be substituted by halogen, lower alkyl, such as methyl or isopropyl, or di(lower alkyl)amino, such as dimethylamino.

Of the compounds of the formula (2), the lacetone compounds in which $X_1$ is a 3-indolyl radical of the formula (2a) where $W_1$ is $C_1$–$C_8$alkyl, $W_2$ is methyl or phenyl and $Y_1$ is lower alkylcarbonyloxy, in particular acetyloxy, are preferred.

Of particular interest are lactone compounds of the formula

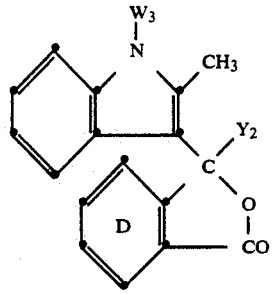

(3)

where the ring D is either unsubstituted or substituted by 4 chlorine atoms, $Y_2$ is benzoyloxy or in particular acetyloxy, and $W_3$ is $C_1$–$C_8$alkyl, e.g. ethyl, n-butyl or n-octyl.

Particular preference is also given to lactone compounds of the formula

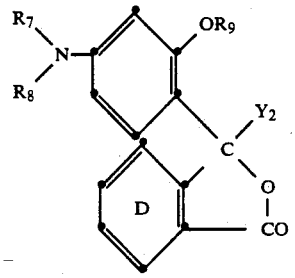

(4)

where D and $Y_2$ are each as defined for the formula (3) and $R_7$, $R_8$ and $R_9$ are each lower alkyl, in particular ethyl or n-butyl.

Compounds of the formula (1) where the detachable substituent Y is an acyloxy group can be prepared by reacting a keto acid or carbinol compound (lactol) of the formula

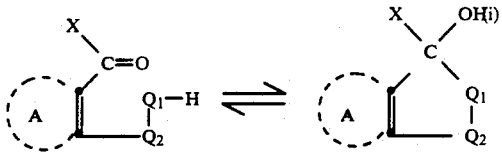

where A, $Q_1$, $Q_2$ and X are each as defined above, with an acylating agent.

Suitable acylating agents are reactive functional derivatives of aliphatic, cycloaliphatic or aromatic carboxylic acids or sulfonic acids, in particular carbonyl halides or carboxylic anhydrides, e.g. acetyl bromide, acetyl chloride, benzoyl chloride or in particular acetic anhydride. It is also possible to use mixed anhydrides, i.e. anhydrides of two different acids.

Compounds of the formula (1) where the detachable substituent Y is halogen are prepared by replacing the hydroxyl group of the carbinol compound of the formula (i) by a halogen atom using a halogenating agent, for example by means of thionyl chloride, phosgene, phosphoryl chloride, phosphorus trichloride or phosphorus pentachloride in dimethylformamide, dichlorobenene, benzene, toluene or ethylene dichloride. The halogenating agent can also be used without a solvent if used in excess.

By reacting compounds of the formula (1) where Y is halogen or acyloxy with aliphatic, cycloaliphatic, araliphatic, aromatic or heterocyclic hydroxy compounds it is possible to introduce ether groups as further detachable substituents Y.

Compounds of the formula (1) where the detachable substituent Y is an ether group can also be obtained by etherifying the compounds of the formula (i) with an alkylating or aralkylating agent.

Suitable alkylating agents are alkyl halides, e.g. methyl iodide, ethyl iodide or ethyl chloride, or dialkyl sulfates, such as dimethyl sulfate or diethyl sulfate. Suitable aralkylating agents are in particular benzyl chloride or the corresponding substitution products, e.g. 4-chlorobenzyl chloride, which are preferably used in an apolar organic solvent, e.g. benzene, toluene or xylene.

Specific examples of compounds of the formulae (1) to (4) as mentioned inter alia in J. Am. Chem. Soc. 38 (1916) 2101–2119 and Helvetica Chimica Acta 42 (1959) 1085–1100 include 3-(4'-diethylamino-2'-ethoxyphenyl)-3-acetyloxyphthalide,
3-(4'-diethylaminophenyl)-3-acetyloxyphthalide,
3-(1'-ethyl-2'-methylindol-3'-yl)-3-acetyloxyphthalide,
3-(4'-dimethylaminophenyl)-3-acetyloxy-6-dimethylaminophthalide,
3-(1'-n-octyl-2'-methylindol-3'-yl)-3-acetyloxyphthalide,
3-(1'-ethyl-2'-methylindol-3'-yl)-3-acetyloxy-4,5,6,7-tetrachlorophthalide,
3-(1'-ethyl-2'-methylindol-3'-yl)-3-acetyloxy-5,6-dichlorophthalide,
3-(1'-n-octyl-2'-methylindol-3'-yl)-3-acetyloxy-4,5,6,7-tetrachlorophthalide,
3-(1'-n-octyl-2'-methylindol-3'-yl)-3-acetyloxy-5,6-dichlorophthalide,
3-(1'-n-octyl-2'-methylindol-3'-yl)-3-acetyloxy-5-methylphthalide,
3-(1'-ethyl-2'-methylindol-3'-yl)-3-acetyloxy-4-azaphthalide,
3-(1'-n-octyl-2'-methylindol-3'-yl)-3-acetyloxy-4-azaphthalide,
3-(1'-ethyl-2'-methylindol-3'-yl)-3-propionyloxy-4,5,6,7-tetrachlorophthalide,
3-(1'-ethyl-2'-methylindol-3'-yl)-3-benzoyloxy-4,5,6,7-tetrachlorophthalide,
3-(1'-methyl-2'-phenylindol-3'-yl)-3-acetyloxy-4,5,6,7-tetrachlorophthalide,
3-(1'-n-octyl-2'-methylindol-3'-yl)-3-acetyloxy-7-azaphthalide,
3-(4'-diethylamino-2'-acetyloxyphenyl)-3-acetyloxy-4,5,6,7-tetrachlorophthalide,
3-(4'-N-cyclohexyl-N-methylamino-2'-ethoxyphenyl)-3-acetyloxyphthalide,
3-(4'-N-cyclohexyl-N-methylamino-2'-methoxyphenyl)-3-acetyloxy-4-azaphthalide,
3-(4'-N-ethyl-N-p-toluidino-2'-methoxyphenyl)-3-acetyloxyphthalide,
3-(4'-N-ethyl-N-isoamylamino-2'-methoxyphenyl)-3-acetyloxyphthalide,
3-(4'-pyrrolidino-2'-methoxyphenyl)-3-acetyloxyphthalide,
3-(4'-diethylamino-2'-ethoxyphenyl)-3-acetyloxy-4-azaphthalide,
3-(4'-dimethylamino-5'-methylphenyl)-3-acetyloxyphthalide,
3-(4'-diethylamino-5'-methylphenyl)-3-acetyloxyphthalide,
3-(2'-acetyloxy-4'-dimethylamino-5'-methylphenyl)-3-acetyloxyphthalide,
3-(4'-di-n-butylamino-2'-n-butoxyphenyl)-3-acetyloxyphthalide,
3-(4'-di-n-butylamino-2'-ethoxyphenyl)-3-acetyloxyphthalide,
3-(4'-diethylamino-2'-n-propoxyphenyl)-3-acetyloxyphthalide,
3-(3'-methoxyphenyl)-3-acetyloxy-6-dimethylaminophthalide,
3-(4'-diethylamino-2'-ethoxyphenyl)-3-acetyloxy-4,5,6,7-tetrachlorophthalide,
3-(4'-di-n-butylamino-2'-ethoxyphenyl)-3-acetyloxy-4,5,6,7-tetrachlorophthalide,
3-(4'-di-n-pentylamino-2'-ethoxyphenyl)-3-acetyloxyphthalide,
3-(4'-diethylamino-2'-acetyloxyphenyl)-3-acetyloxyphthalide,
3-(4'-diethylamino-5'-methyl-2'-acetyloxyphenyl)-3-acetyloxy-4,5,6,7-tetrachlorophthalide,
3-(4'-di-n-butylaminophenyl)-3-acetyloxyphthalide,
3-(4'-dimethylaminophenyl)-3-acetyloxy-6-chlorophthalide,
3-(4'-di-2''-cyclohexylethylaminophenyl)-3-acetyloxyphthalide,
3-(julolidin-6'-yl)-3-acetyloxyphthalide,
3-kairolinyl-3-acetyloxyphthalide,
3-(2',4'-bis-dimethylaminophenyl)-3-acetyloxyphthalide,
3-(2'-acetylamino-4'-dimethylaminophenyl)-3-acetyloxyphthalide,
3-(N-ethyl-carbazol-(3')-yl)-3-acetyloxyphthalide,
3-(1'-ethyl-2'-methylindol-(3')-yl)-3-chlorophthalide,
3-(1'-ethyl-2'-methylindol-(3')-yl)-3-chlorobenzoxathiole 1,1-dioxide,
3-(4'-diethylamino-2'-ethoxyphenyl)-3-chlorophthalide,
3-(4'-dimethylaminophenyl)-3-methoxy-6-dimethylaminophthalide,
3-(1'-ethyl-2'-methylindol-(3')-yl)-3-methoxy-4,5,6,7-tetrachlorophthalide,
3-(1'-ethyl-2'-methylindol-3'-yl)-3-benzyloxy-4,5,6,7-tetrachlorophthalide,
3-(2'-methylindol-3'-yl)-3-methoxyphthalide,
3-(1'-n-butyl-2'-methylindol-3'-yl)-3-methoxyphthalide,
3-(2'-acetyloxy-5'-bromophenyl)-3-acetyloxyphthalide,
3-(3'-diacetylamino-4'-methylphenyl)-3-acetyloxyphthalide,
3-(4'-chlorophenyl)-3-chlorophthalide.

Suitable condensation components (component B) are all coupling components customary in azo chemistry and known from the relevant literature, e.g. H. R. Schweizer, Künstliche Org. Farbstoffe und ihre Zwischenprodukte, Springer-Verlag 1964, pp. 420.

Of the multiplicity of possibilities there may be mentioned for example: condensation components of the benzene series, the naphthalene series, the open-chain active methylene compounds and the heterocyclic series, in particular indole compounds.

Examples of condensation components are N-substituted aminophenylethylene compounds, N-substituted aminophenylstyrene compoundsd, acylacetarylamides, monohydric or polyhydric phenols, phenol ethers (phenetols), 3-aminophenol ethers, anilines, naphthylamines, thionaphthenes, diarylamines, aminoanilines, anilinesulfonanilides, aminodiarylamines, naphthols, naphtholcarboxanilides, morpholines, pyrrolidines, piperidines, piperazines, aminopyrazoles, aminopyrimidines, pyrazolones, thiophenes, acridines, aminothiazoles, phenothiazines, pyridones, indoles, indolizines, quinolones, pyrimidones, barbituric acids, carbazoles, benzomorpholines, 2-methylenebenzopyrans, dihydroquinolines, tetrahydroquinolines, indolines, kairolines and julolidines.

Particularly preferred condensation components are anilines, such as cresidines, phenetidines or N,N-di(-lower alkyl)anilines,2-(lower alkyl)indoles, 3-(lower alkyl)indoles or 2-phenylindoles, which may each be N-substituted by $C_1$–$C_8$alkyl, and also 5-pyrazolones. Further preferred coupling components are 3-(lower alkyl)-6-(lower alkoxy)- or -6-di(lower alkyl)aminoindoles, which may each likewise be N-substituted by $C_1$–$C_8$alkyl.

Specific examples of condensation components are 2-amino-4-methoxytoluene, 3-amino-4-methoxytoluene, 3-amino-4-methoxy-1-ethylbenzene, N,N-dimethylaniline, 4-isopropylaniline, N,N-diethylaniline, N,N-dibenzylaniline, 3-n-butoxy-N,N-di-n-butylaniline, 2-methyl-5-acetyloxy-N,N-diethylaniline, 4-ethoxydiphenylamine, 4-aminodiphenylamine, 3-ethoxy-N,N-dimethylaniline, N,N'-diphenyl-p-phenylenediamine, m-phenetidine, 3-ethoxy-N,N-diethylaniline, 1,3-bisdimethylaminobenzene, 4-aminotoluene-2-sulfonanilide, 4-aminotoluene-2-(N-ethyl)sulfonanilide, 3-hydroxy-N,N-(di-2'-cyclohexylethyl)aminobenzene, 1,1-(4'-diethylaminophenyl)ethylene, 1-phenyl-3-methyl-5-pyrazolone, 1-phenyl-5-methyl-3-pyrazolone, 1-(2'-chlorophenyl)-5-methyl-3-pyrazolone, N-ethylcarbazole, N-methylpyrrole, 2-methylindole, 2-phenylindole, 1,2-dimethylindole, 1-ethyl-2-methylindole, 1-n-octyl-2-methyl-indole, 1-phenoxyethyl-2-methylindole, 1-methyl-2-phenylindole, 1-ethyl-2-phenylindole, 2-(4'-methoxyphenyl)-5-methoxyindole, 3-methyl-6-methoxyindole, 3-methyl-6-dimethylaminoindole, 1-ethyl-3-methyl-6-methoxyindole, 1-ethyl-3-methyl-6-dimethylaminoindole, 2-(4'-methoxyphenyl)-5-methoxyindole, α-naphthol, β-naphthol, α- or β-naphthylamine, 1-amino-7-naphthol, 3-cyanoacetylaminophenol, thionaphthene, phenothiazine, 3-methyl-5-aminopyrazole, ethyl pyrimidyl-2-acetate, iminodibenzyl, 1-benzyl-2-methylindoline, 2,3,3-trimethylindolenine, benzothiazol-2-yl-acetonitrile, 1,3,3-trimethyl-2-methyleneindoline, 1-ethyl-3-cyano-4-methyl-6-hydroxy-2-pyridone, 3-phenyl-4-methylindolizine, 2,3-diphenylindolizine, 1,1-bis(1'-ethyl-2'-methylindol-3'-yl)ethylene, 2-dimethylamino-4-methylthiazole, 2-dimethylamino-4-phenylthiazole and 2-methylene-3-methylbenzopyran.

Preferred components (B) also include phthalide and in particular fluoran compounds which have at least one primary amino group or a lower alkyl-, cyclohexyl- or benzyl-monosubstituted amino group. These phthalide and fluran compounds are described for example in FR-A-1 553 291, GB-A-1 211 393, DE-A-2 138 179, DE-A-2 422 899 and EP-A-138 177.

Specific examples of such components (B) are:

2-amino-6-diethylaminofluoran,
2-amino-6-dibutylaminofluoran,
2-amino-3-chloro-6-diethylaminofluoran,
2-methylamino-6-dimethylaminofluoran,
2-ethylamino-6-diethylaminofluoran,
2-methylamino-6-diethylaminofluoran,
2-n-butylamino-6-diethylaminofluoran,
2-n-octylamino-6-diethylaminofluoran,
2-sec-butylamino-6-diethylaminofluoran,
2-benzylamino-6-diethylaminofluoran,
2,3-dimethyl-6-ethylaminofluoran,
2,3,7-trimethyl-6-ethylaminofluoran,
2,3,7-trimethyl-6-ethylamino-5'(6')-tert-butylfluoran,
2-chloro-3,7-dimethyl-6-ethylamino-5'(6')-tert-butylfluoran,
2-tert-butyl-6-ethylamino-7-methyl-5'(6')-tert-butylfluoran,
3-chloro-6-aminofluoran, 3-chloro-6-cyclohexylaminofluoran,
2,7-dimethyl-3,6-bisethylaminofluoran,
2-(2'-chloranilino)-6-ethylamino-7-methylfluoran,
3,3-bis(4'-dimethylaminophenyl)-6-aminophthalide,
3,3-bis(4'-ethylaminophenyl)-6-dimethylaminophthalide.

The ratios in which components (A) and (B) are used are not critical, but they are preferably used in equimolar amounts.

Not only polycyclic components (A) but also the condensation components (B) can be used in the recording material alone or as mixtures in the form of a combination of two or more thereof.

Component (C) can be an inorganic or an organic colour developer known for recording materials which is capable of attracting electrons, i.e. which acts as an electron acceptor. Component (C), which under the action of pressure undergoes a colour-forming reaction with components (A) and (B), can be used in the pressure-sensitive recording material alone or as a mixture.

Typical examples of inorganic developers are active clay substances, such as attapulgite clay, acid clay, bentonite, montmorillonite, activated clay, e.g. acid-activated bentonite or montmorillonite, and also halloysite, kaolin, zeolite, silicon dioxide, zirconium dioxide, aluminium oxide, aluminium sulfate, aluminium phosphate or zinc nitrate.

Preferred inorganic colour developers are Lewis acids, e.g. aluminium chloride, aluminium bromide, zinc chloride, iron(III) chloride, tin tetrachloride, tin dichloride, tin tetrabromide, titanium tetrachloride, bismuth trichloride, tellurium dichloride or antimony pentachloride.

Suitable organic colour developers are solid carboxylic acids, advantageously aliphatic dicarboxylic acids, e.g. tartaric acid, oxalic acid, maleic acid, citric acid, citraconic acid or succinic acid, and also alkylphenol-acetylene resin, maleic acid-rosin resin, carboxypolymethylene or a partially or completely hydrolysed polymer of maleic anhydride with styrene, ethylene or vinyl methyl ether.

Suitable organic colour developers are in particular compounds having a phenolic hydroxyl group. They can be not only monohydric but also polyhydric phenols. These phenols may be substituted by halogen atoms, carboxyl groups, alkyl radicals, aralkyl radicals, such as α-methylbenzyl or α,α-dimethylbenzyl, aryl radicals, acyl radicals, such as arylsulfonyl, or alkoxycarbonyl radicals or aralkoxycarbonyl radicals, such as benzyloxycarbonyl.

Specific examples of phenols suitable for use as component (C) are 4-tert-butylphenol, 4-phenylphenol, methylenebis(p-phenylphenol), 4-hydroxydiphenyl ether, α-naphthol, β-naphthol, methyl or benzyl 4-hydroxybenzoate, methyl 2,4-dihydroxybenzoate, 4-hydroxydiphenyl sulfone, 4'-hydroxy-4-methyldiphenyl sulfone, 4'-hydroxy-4isopropoxydiphenyl sulfone, 4-hydroxyacetophenone, 2,4-dihydroxybenzophenone, 2,2'-dihydroxybiphenyl, 2,4-dihydroxydiphenyl sulfone, 4,4'-cyclohexylidenediphenol,4,4'-isopropylidenediphenol (bisphenol A), 4,4'-isopropylidenebis(2-methylphenol), 4,4'-bis-(4-hydroxyphenyl)valeric acid, resorcinol, hydroquinone, pyrogallol, phloroglucine, p-, m- or o-hydroxybenzoic acid, 3,5-di(α-methylbenzyl)salicylic acid, 3,5-di(α,α-dimethylbenzyl)salicylic acid, salicylosalicylic acid, alkyl gallates, gallic acid, hydroxyphthalic acid, 1-hydroxy-2-naphthoic acid and also phenolformaldehyde prepolymers which may also be modified with zinc. Of the carboxylic acids mentioned, the salicylic acid derivatives are preferred, and they are preferably used in the form of zinc salts. Particularly preferred zinc salicylates are described in EP-A-181 283 and DE-A-2 242 250.

Highly suitable compounds for use as component (C) also include organic complexes of zinc thiocyanate and in particular an antipyrine complex of zinc thiocyanate, a pyridine complex of zinc thiocyanate or a cresidine complex of zinc thiocyanate, as described in EP-A-97 620.

Particularly preferred components (C) are active clay or zinc salicylates, e.g. zinc 3,5-bis-α-methylbenzylsalicylate.

Not only components (A) and (B) but in particular the developer (component (C)) may additionally be used mixed with inherently unreactive or slow-reacting pigments or further assistants such as silica gel or UV absorbers, e.g. 2-(2'-hydroxyphenyl)benzotriazoles, 2-hydroxyphenyltriazines, benzophenones, cyanoacrylates, and phenyl salicylates. Examples of such pigments are: talc, titanium dioxide, aluminum oxide, aluminium hydroxide, zinc oxide, chalk, magnesium carbonate, clays such as kaolin, and also organic pigments, e.g. urea-formaldehyde condensates (BET surface area 2–75 $m^2/g$) or melamine-formaldehyde condensation products.

The mixing ratio of component (C) to components (A) and (B) depends on the nature of the three components, the nature of the colour change and of course also on the desired colour concentration. Satisfactory results are obtained on using the colour-developing component (C) in amounts of from 0.1 to 100 parts by weight, preferably from 1 to 20 parts by weight, per part of components (A) and (B) together.

The colour-forming component (A) or (B) present in the transfer sheet is preferably dissolved in an organic solvent and the solution obtained is advantageously encapsulated by methods as described for example in U.S. Pat. Nos. 2,712,507, 2,800,457, 3,016,308, 3,429,827, 4,100,103 and 3,578,605 or in British Patents 989,264, 1,156,725, 1,301,052 and 1,355,124. It is also possible to use microcapsules which are formed by interface polymerisation, for example capsules made of polyester, polycarbonate, polysulfonamide or polysulfonate or in particular of polyamide, polyurea or polyurethane. In some cases it is sufficient to encapsulate the solvent only. Encapsulation is in general necessary to prevent premature colour formation. This can also be achieved by incorporating, for example, component (A) or (B) in a foamlike, spongelike or honeycomblike structure.

Examples of suitable solvents are preferably non-volatile solvents, for example halogenated benzene, biphenyls or paraffin, e.g. chloroparaffin, trichlorobenzene, monochlorobiphenyl, dichlorobiphenyl or trichlorobiphenyl; esters, e.g. dibutyl adipate, dibutyl phthalate, dioctyl phthalate, butyl benzyl adipate, trichloroethyl phosphate, trioctyl phosphate, tricresyl phosphate; aromatic ethers such as benzyl phenyl ether; hydrocarbon oils, such as paraffin oil or kerosine, aromatic hydrocarbons, e.g. isopropyl-, isobutyl-, sec-butyl- or tert-butyl-alkylated derivatives of benzene, biphenyl, naphthalene or terphenyl, dibenzyltoluene, partially hydrogenated terphenyl, mono- to tetra-$C_1$–$C_3$-alkylated diphenylalkanes, dodecylbenzene, benzylated xylenes, phenylxylylethane or further chlorinated or hydrogenated, fused, aromatic hydrocarbons. Frequently, mixtures are used of various solvents, in particular mixtures of paraffin oils or kerosine and diisopropylnaphthalene or partially hydrogenated terphenyl in order to achieve maximum solubility for the colour formation, a rapid and intensive colouring and an optimal viscosity for microencapsulation.

The microcapsules which contain component (A) or (B) or only the solvent can be used for producing pressure-sensitive copy materials for a wide range of imaging systems. The various systems differ essentially in the arrangement of the capsules, the colour reactants and the base material.

Preference is given to an arrangement in which the encapsulated component (A) is present in the form of a layer on the back of a transfer sheet and component (B) and the electron acceptor (component (C)) are present in the form of one or two individual layers on the front of a receptor sheet. In another arrangement, the transfer sheet contains component (B) and component (A) and electron acceptor (C) are present on the receptor sheet. The two arrangements can also be reversed.

The recording material of the present invention also encompasses a base sheet whose back contains encapsulated solvent for components (A) and (B) and a further sheet whose surface has been coated with components (A), (B) and (C). One of the components (A) and (B), or both, can also have been incorporated in the lower sheet (receptor sheet).

To produce the recording materials of the present invention, the microcapsules which contain component (A) or (B) or the solvent are applied to the surface of a base material and preferably bonded thereto with a binder in an amount which will secure adequate adhesion to the base material. Since paper is the preferred base material, this binder will usually be a paper-coating agent, for example gum arabic, polyvinyl alcohol, hydroxymethylcellulose, casein, carboxymethylcellulose, dextrin, starch, starch derivatives or polymer latices, and mixtures thereof. Latices are for example butadiene-styrene copolymers or acrylic homopolymers or copolymers. Preference is given to using carboxylated latices.

The paper used need not be a normal paper made of cellulose fibres but can also be a paper in which the cellulose fibres have been replaced (as a whole or in part) by fibres made of synthetic polymers. The base material can also be a plastics film.

The base material is preferably coated with a coating composition which contains a binder and reaction component (A) or (B). The coating composition can be used either in the form of an aqueous or non-aqueous system, i.e. in an organic solvent system or in a hot melt wax system.

To prevent premature destruction of the capsules in the course of the making and handling of the copy papers, it is preferable to incorporate spacers into the coating composition. Spacers used are cellulose powder or cellulose flour and/or insoluble wheat starch. Mixtures of cellulose powder and starch are also used.

To obtain the desired colour the capsule material which contains components (A) and (B) can be mixed, alone or together, with one or more conventional colour formers. The latter may be present not only in the capsule materials, encapsulated separately or together, but also in the dispersions.

In the methods of preparation and examples which follow, parts and percentages are by weight, unless otherwise stated.

METHODS OF PREPARATION

Method A 19.3 g of 3-(1'-ethyl-2'-methylindol-3'-yl)-3-hydroxy-4,5,6,7-tetrachlorophthalide (or the tautomer of the corresponding keto acid) are added to 20 ml of acetic anhydride with stirring at 25° C. The mixture is heated to 117° C., that temperature is maintained for 2½ hours, and 15 ml of glacial acetic acid are added, and the product is then filtered off at 80° C. The residue is washed with petroleum ether and dried under reduced pressure. This leaves 12.4 g of the lactol ester of the formula (5)

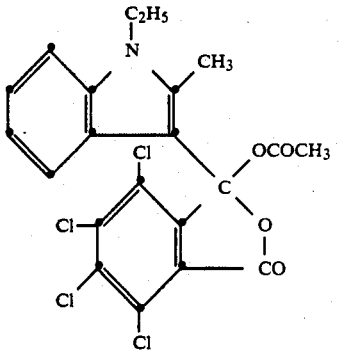

in the form of white crystals. Following recrystallisation from toluene/acetic anhydride the pure product has a melting point of 187°-188° C. (decomposition).

The IR spectrum shows the acetate CO band at 1770 $cm^{-1}$ and the lactone CO band at 1790 $cm^{-1}$.

Method B

The procedure described in method A is repeated, except that the acetic anhydride is replaced by 25 ml of propionic anhydride and the temperature is maintained at 110° C. for 3 hours, affording, on recrystallisation of toluene, 3.8 g of the lactol ester of the formula (6)

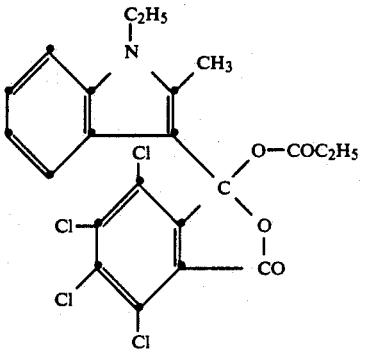

having a melting point of 197°-198° C.

Method C 26.5 g of 3-(1'-n-octyl-2'-methylindol-3'-yl)-3-hydroxy-4,5,6,7-tetrachlorophthalide (or the tautomer of the corresponding keto acid) are heated in 30 ml of acetic anhydride to 80°-85° C. and stirred at that temperature for 3 hours. A solution forms, from which the product is precipitated by cooling and then filtered off. It is washed with glacial acetic acid and petroleum ether. Recrystallisation from toluene gives 17.2 g of the lactol ester of the formula (7)

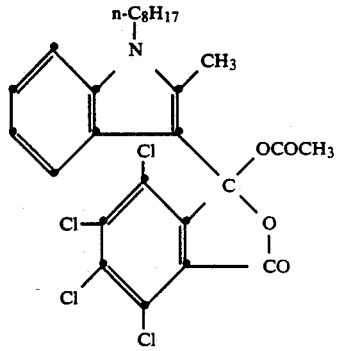

having a melting point of 146°-148° C. (decomposition).

Method D

The procedure described in method A is repeated, except that the phthalide described there is replaced by 24.6 g of 3-(1'-methyl-2'-phenylindol-3'-yl)-3-hydroxy-4,5,6,7-tetrachlorophthalide, affording on recrystallisation from toluene 14.3 g of the lactol ester of the formula (8)

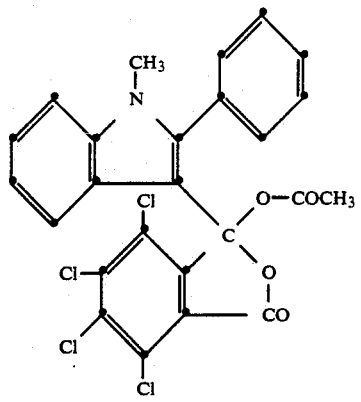

having a melting point of 220°-221° C. (decomposition).

Method E 4.5 g of 2-(2'-ethoxy-4'-diethylaminobenzoyl)-3,4,5,6-tetrachlorobenzoic acid are dissolved in 15 g of acetic anhydride at 45° C. and maintained at 65°-70° C. for 7 hours. The product crystallises out on cooling and is filtered off at 20° C. Drying leaves 3 g of a lactol ester of the formula (9)

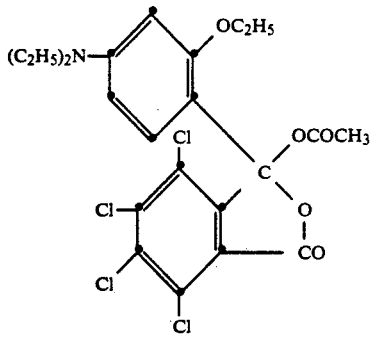

Following purification with petroleum ether this compound has a melting point of 185°-186° C. with decomposition.

Method F 4.8 g of the lactol ester of the formula (5) of method A are refluxed in 100 ml of methanol for 1 hour with stirring. Cooling the mixture and filtering gives 4 g of a phthalide compound of the formula (10)

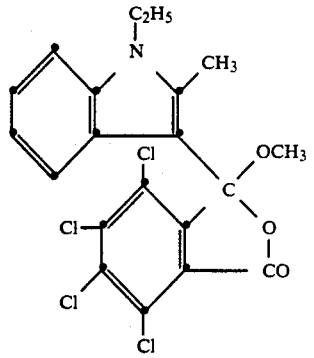

Recrystallised from toluene and methanol the product has a melting point of 184°-185° C.

Method G

The procedure described in method F is repeated, except that the methanol is replaced by 50 ml of benzyl alcohol, affording a phthalide compound of the formula (11)

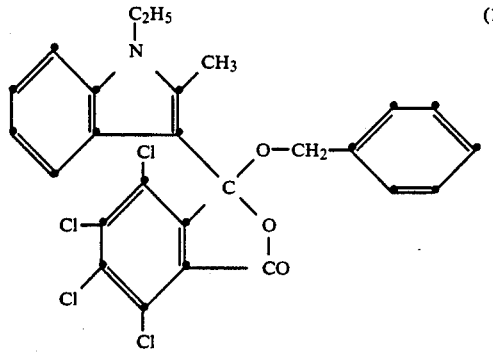

melting point 183°-184° C.

Method H

The procedure described in method C is repeated, except that the acetic anhydride is replaced by 30 ml of propionic anhydride, the reaction temperature is maintained at 75°-78° C. for 2½ hours and before being filtered the mixture is diluted with 10 ml of propionic anhydride, affording on drying 18.8 g of the lactol ester of the formula (12)

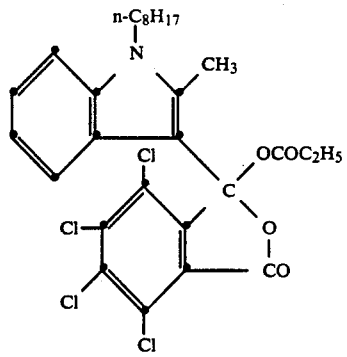

having a melting point of 154°-155.5° C. (decomposition).

Method I 36.9 g of 2-(4'-dibutylamino-2'-hydroxybenzoyl)benzoic acid are suspended in 240 ml of acetone and 40 ml of diethyl sulfate at 35° C. A solution of 16.8 g of potassium hydroxide in 50 ml of water is added dropwise at 35° C. (±2° C.) over 4 hours and the mixture is then reacted at that temperature for 20 hours. A further 11.2 g of potassium hydroxide, dissolved in 50 ml of water, is added, and all of the acetone is distilled off azeotropically to a base of column temperature of 96° C. This is followed by stirring at 90°-95° C. for a further 2 hours. After the mixture has cooled down to 10° C., 18 ml of concentrated hydrochloric acid are added dropwise, and the product precipitates. The mixture is stirred at 15°-20° C. for 16 hours and filtered, and the product is washed with water. Drying leaves 39.2 g of the compound of the formula (ii)

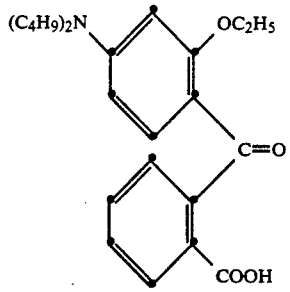

having a melting point of 166°-168° C.

11.9 g of the compound of the formula (ii) are suspended in 36 ml of acetic anhydride, heated and maintained at 65°-70° C. for ½ hour. The solution formed is poured with vigorous stirring into a mixture of 150 ml of toluene and 360 ml of 15% sodium carbonate solution, the aqueous phase is separated off, and the toluene phase is washed with water, dried over sodium sulfate and concentrated under reduced pressure. This gives 13 g of the compound of the formula (13)

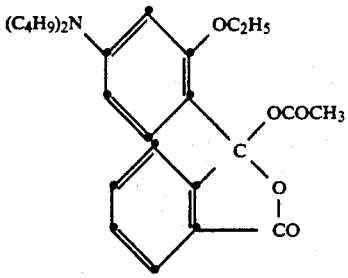

in the form of an orange oil.

Method K 17 g of 2-(4'-diethylamino-2'-ethoxybenzoyl)benzoic acid are suspended in 60 ml of acetic anhydride at 65°-70° C. for 45 minutes, and an orange solution forms. This solution is poured with thorough stirring into a mixture of 250 ml of toluene and 600 ml of 15% sodium carbonate solution. The alkaline aqueous phase is separated off, and the toluene phase is washed with water, dried over sodium sulfate and concentrated to dryness. The residue is recyrystallised from 1:1 toluene/petroleum ether and dried, leaving 13.2 g of the compound of the formula (14)

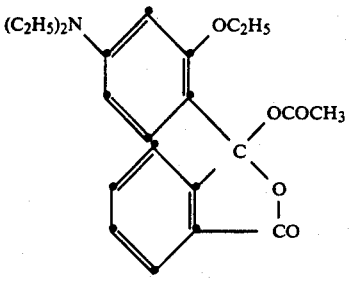

having a melting point of 95°-97° C. with decomposition.

Method L 45.2 g of benzoic anhydride are melted at 50° C. 8.9 g of 3-(1'-ethyl-2'-methylindol-3'-yl)-3-hydroxy-4,5,6,7-tetrachlorophthalide (or the tautomer of the corresponding keto acid) are added at that temperature, the temperature is raised to 100° C. and is maintained at that level for 3 hours. The mixture is cooled down to 50° C., 25 ml of methyl ethyl ketone and 10 ml of petroleum ether are added, and the mixture is allowed to crystallise at 20° C. for 2 hours. Filtration and drying gives 2.9 g of the compound of the formula (15)

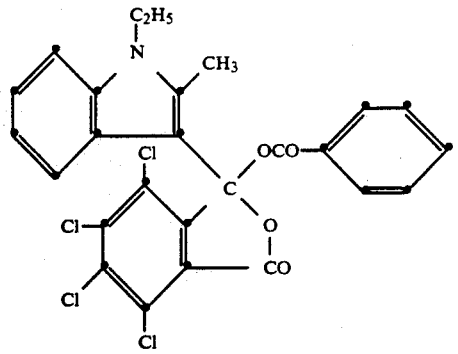

which when recrystallised from methyl ethyl ketone in a pure form has a melting point of 129°-131° C.

EXAMPLE 1

3.25 g of 3-(1'-ethyl-2'-methylindol-3'-yl)-3-acetyloxy-4,5,6,7-tetrachlorophthalide are dissolved in 96.75 g of diisopropylnaphthalene and microencapsulated in a conventional manner with gelatin and carboxymethylcellulose by coacervation. The capsule mass is mixed with starch solution and cellulose powder and applied to a 50 g/m$^2$ receptor paper. The add-on weight in absolutely dry terms of the CB sheet obtained is 7 g/m$^2$.

50 g 2-phenylindole, 25 g of a polyvinyl alcohol solution (10%) and 125 g of water are ball-milled with glass beads to an average particle size of 1.2 μm. 5 g of the dispersion are mixed with 15 g of a 20% slurry of zinc 2,5-bis-α-methylbenzylsalicylate in water, and the mixture is then applied to a 50 g/m$^2$ base paper. The CF sheet obtained is dried at 40° C. The add-on weight in absolutely dry terms is 2.1 g/m$^2$.

The CB sheet is placed on top of the CF sheet. On exertion of pressure on the paper with a pen or with a typewriter, a violet copy develops.

EXAMPLE 2

The procedure described in Example 1 is repeated, except that the zinc salicylate slurry is replaced by 15 g of a 20% slurry of active clay in water, again affording a violet copy.

EXAMPLE 3

1.22 g of 1-n-octyl-2-methylindole are dissolved in 98.78 g of diisopropylnaphthalene and microencapsulated in a conventional manner with gelatin and carboxymethylcellulose by coacervation. The capsule material is mixed with starch solution and cellulose flour and applied to a 50 g/m$^2$ receptor paper. The add-on weight of the CB sheet obtained is 7 g/m$^2$ in absolutely dry terms.

50 g of 3-(1'-ethyl-2'-methylindol-3'-yl)-3-acetyloxy-4,5,6,7-tetrachlorophthalide, 25 g of a polyvinyl alcohol solution (10%) and 125 g of water are ball-milled with glass beads to an average particle size of 1.0 μm. 5 g of the dispersion are mixed with 15 g of a 20% slurry of the zinc salicylate of Example 1 of EP-A-181 289 in water, and the mixture is applied to a 50 g/m$^2$ base paper. The CF sheet obtained is dried at 40° C. The add-on weight is 1.6 g/m$^2$ in absolutely dry terms.

The CB sheet is placed on top of the CF sheet. On exertion of pressure on the paper with a pen or with a typewriter, a violet copy develops.

EXAMPLE 4

The procedure of Example 3 is repeated, except that the zinc salicylate slurry is replaced by 15 g of a 20% slurry of active clay in water, again affording a violet copy.

EXAMPLE 5

Diisopropylnaphthalene is microencapsulated in a conventional manner with gelatin and carboxymethylcellulose by coacervation. The capsule material is mixed with starch solution and cellulose flour and applied to a 50 g/m$^2$ receptor paper. The add-on weight of the CB sheet is 7 g/m$^2$ in absolutely dry terms.

50 g of 3-(1'-ethyl-2'-methylindol-3'-yl)-3-acetyloxy-4,5,6,7-tetrachlorophthalide are ball-milled with 25 g of a polyvinyl alcohol solution (10%) and 125 g of water to an average particle size of 1 μm (dispersion A).

Similarly, 50 g of 2-phenylindole and 25 g of a polyvinyl alcohol solution (10%) and 125 g of water are ball-milled to an average particle size of 1.2 μm (dispersion B).

5 cm$^3$ each of dispersions A and B and 15 cm$^3$ of a 20% slurry of zinc 3,5-bis-α-methylbenzylsalicylate in water are mixed and applied to a 51 g/m$^2$ paper by knife-coating. The paper obtained (CF sheet) is dried at 40° C. The add-on weight is 3 g/m$^2$ in absolutely dry terms.

The CB sheet is placed on top of the CF sheet. On exertion of pressure on the paper with a pen or a typewriter, a violet copy develops.

What is claimed is:

1. A pressure-sensitive recording and transfer material containing on a first sheet a coating comprising one of the components (A) and (B) or a solvent for these components and on a second sheet the other or both of the components (A) and (B) and an electron-attracting and colour-developing material as component (C), (A) being a polycyclic compound of the formula

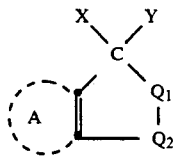

(1)

where

X is a monocyclic or polycyclic aromatic or heteroaromatic radical,

Y is a substituent which is detachable as an anion, $Q_1$ is —O—, —S—,

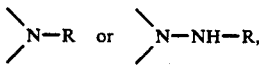

$Q_2$ is —$CH_2$—, —CO—, —CS— or —$SO_2$—,

R is hydrogen, $C_1$–$C_{12}$alkyl, $C_5$–$C_{10}$cycloalkyl, aryl or aralkyl, and the ring A is an aromatic or heterocyclic radical of 6 ring atoms with or without a fused aromatic ring, it being possible for both ring A and the fused ring to be substituted, and (B) being an organic condensation component.

2. A material according to claim 1, wherein in the formula (1) X is pyrrolyl, thienyl, indolyl, carbazolyl, acridinyl, benzofuranyl, benzothienyl, naphthiothienyl, phenothiazinyl, indolinyl, julolidinyl, kairolinyl, dihydroquinolinyl or tetrahydroquinolinyl.

3. A material according to claim 1, wherein in the formula (1) X is pyrrolyl, indolyl, carbazolyl, indolinyl, julolidinyl, kairolinyl, dihydroquinolinyl or tetrahydroquinolinyl.

4. A material according to claim 1, wherein in the formula (1) X is is a substituted 2-pyrrolyl, 3-pyrrolyl or 3-indolyl radical.

5. A material according to claim 1, wherein in the formula (1) X is a 2-methyl-3-indolyl, N—$C_1$–$C_8$alkyl-2-methylindol-3-yl, N—$C_2$–$C_4$alkanoyl-2-methylindol-3-yl, 2-phenylindol-3-yl or N—$C_1$–$C_8$alkyl-2-phenylindol-3-yl radical.

6. A material according to claim 1, wherein in the formula (1) X is unsubstituted or halogen-, cyano-, lower alkyl-, $C_5$–$C_6$cycloalkyl—, $C_1$–$C_8$acyl—, —$R_2R_1N$—, $R_3O$— or $R_3S$-substituted phenyl or naphthyl, where $R_1$, $R_2$ and $R_3$ are each independently of the others hydrogen, unsubstituted or halogen-, hydroxyl-, cyano- or lower alkoxy-substituted alkyl of not more than 12 atoms, acyl of from 1 to 8 carbon atoms, cycloalkyl of from 5 to 10 carbon atoms or unsubstituted or halogen-, cyano-, lower alkyl-, lower alkoxy-, lower alkoxycarbonyl-, X''X'N— or 4-NX'X''-phenylamino-ring-substituted phenylalkyl or phenyl, where X' and X'' are each independently of the other hydrogen, lower alkyl, cyclohexyl, benzyl or phenyl, or $R_1$ and $R_2$ together with the nitrogen atom joining them together are a five- or six-membered heterocyclic radical.

7. A material according to claim 1, wherein the formula (1) X is a substituted phenyl radical of the formula

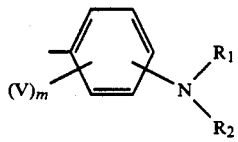

(1a)

or

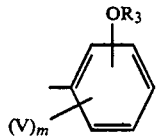

(1b)

where $R_1$, $R_2$ and $R_3$ are each independently of the others hydrogen, unsubstituted or halogen-, hydroxyl-, cyano- or lower alkoxy-substituted alkyl of not more than 12 carbon atoms, acyl of from 1 to 8 carbon atoms, cycloalkyl of from 5 to 10 carbon atoms or unsubstituted or halogen-, trifluoromethyl-, cyano-, lower alkyl-, lower alkoxy-, lower alkoxycarbonyl-, X''X'N- or 4-NX'X''-phenylamino-ring-substituted phenalkyl or phenyl, where X' and X'' are each independently of the other hydrogen, lower alkyl, cyclohexyl, benzyl or phenyl, or $R_1$ and $R_2$ together with the nitrogen atom joining them together are a five- or six-membered heterocyclic radical, V is hydrogen, halogen, lower alkyl, $C_1$–$C_{12}$alkoxy, $C_1$–$C_{12}$acyloxy, benzyl, phenyl, benzyloxy, phenyloxy, halogen-, cyano-, lower alkyl- or lower alkoxy-substituted benzyl or benzyloxy, or the group —$NT_1T_2$; $T_1$ is hydrogen, lower alkyl, $C_5$–$C_6$cycloalkyl, unsubstituted or halogen-, cyano-, lower alkyl- or lower alkoxy-substituted benzyl or acyl of from 1 to 8 carbon atoms or unsubstituted or halogen-, cyano-, lower alkyl or lower alkoxy-substituted phenyl, $T_2$ is hydrogen, lower alkyl, $C_5$–$C_6$cycloalkyl, unsubstituted or halogen-, cyano-, lower alkyl- or lower alkoxy-substituted benzyl or acyl of from 1 to 8 carbon atoms and m is 1 or 2.

8. A material according to claim 1, wherein in the formula (1) Y is halogen, an aliphatic, cycloaliphatic, araliphatic, aromatic or heterocyclic ether group or an acyloxy group.

9. A material according to claim 1, wherein in the formula (1) Y is an acyloxy group of the formula $$R'—(NH—)_{n-1}—Q'—O— \quad (1c)$$

where R' is substituted or unsubstituted $C_1$–$C_{22}$alkyl, cycloalkyl, aryl, aralkyl or hetaryl, Q' is —CO— or —$SO_2$— and n is 1 or 2.

10. A material according to claim 1, wherein in the formula (1) Y is an acyloxy group of the formula R''—CO—O— where R'' is lower alkyl or phenyl.

11. A material according to claim 1, wherein in the formula (1) $Q_1$ is oxygen and $Q_2$ is —CO—.

12. A material according to claim 1, wherein in the formula (1) the ring A is a substituted or unsubstituted benzene, naphthalene, pyridine, pyrazine, quinoxaline or quinoline ring.

13. A material according to claim 1, wherein in the formula (1) the ring A is an unsubstituted or halogen-substituted benzene ring.

14. A material according to claim 1, wherein component (A) is a lactone compound of the formula

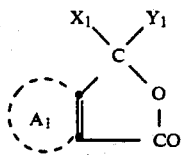

(2)

where $A_1$ is an unsubstituted or halogen-, cyano-, lower alkyl-, lower alkoxy- or di(lower alkyl)amino-substituted benzene or pyridine ring, $Y_1$ is halogen or acyloxy and $X_1$ is a 3-indolyl radical of the formula

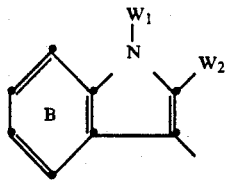

(2a)

or a substituted phenyl radical of the formula

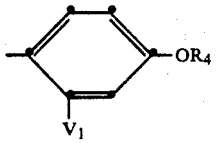

(2b)

or

-continued

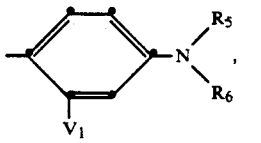

(2c)

where $W_1$ is hydrogen, substituted or cyano- or lower alkoxy-substituted $C_1$–$C_8$alkyl, acetyl, propionyl or benzyl, $W_2$ is hydrogen, lower alkyl or phenyl, $R_4$, $R_5$ and $R_6$ are each independently of the others unsubstituted or hydroxyl-, cyano- or lower alkoxy-substituted alkyl of not more than 12 carbon atoms, $C_5$–$C_6$cycloalkyl, benzyl, phenethyl or phenyl, or ($R_5$ and $R_6$) together with the nitrogen atom joining them together are pyrrolidino, piperidino or morpholino, $V_1$ is hydrogen, halogen, lower alkyl, $C_1$–$C_8$alkoxy, benzyloxy or the group —$NT_3T_4$, $T_3$ and $T_4$ are each independently of the other hydrogen, lower alkyl, lower alkylcarbonyl or unsubstituted or halogeno-, methyl- or methoxy-substituted benzoyl, and the ring B may be substituted by halogen, lower alkyl or di(lower alkyl)amino.

15. A material according to claim 14, wherein the formula (2) $X_1$ is a 3-indolyl radical of the formula 2(a) where $W_1$ is $C_1$–$C_8$alkyl, $W_2$ is methyl or phenyl and $Y_1$ is lower alkylcarbonyloxy.

16. A material according to claim 1, wherein component (A) is a lactone compound of the formula

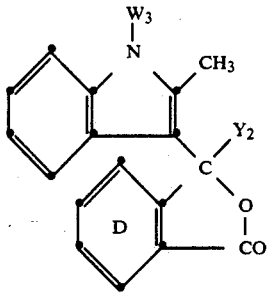

(3)

wherein the ring D is unsubstituted or substituted by 4 chlorine atoms, $Y_2$ is acetyloxy or benzoyloxy and $W_3$ is $C_1$–$C_8$alkyl.

17. A material according to claim 1, where component (A) is a lactone compound of the formula

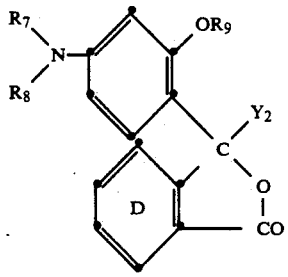

(4)

wherein the ring D is unsubstituted or substituted by 4 chlorine atoms, $Y_2$ is acetyloxy or benzoyloxy and $R_7$, $R_8$ and $R_9$ are each lower alkyl.

18. A material according to claim 1, wherein the condensation component (B) is a member selected from the group consisting of an N-substituted aminophenylethylene, N-substituted aminophenylstyrene, acylacetarylamide, monohydric or polyhydric phenol, phenol ether, 3-aminophenol ether, aniline, naphthylamine, diarylamine, naphthol, naphtholcarboxanilide, aminopyrazole, pyrazolone, thiophene, thionaphthene, phenothiazine, aminothiazole, aminopyrimidine, acridine, pyridone, indole, carbazole, kairoline, indolizine, julolidine, morpholine, pyrrolidine, piperidine, piperazine, indoline, quinolone, pyrimidone, barbituric acid, benzomorpholine, dihydroquinoline and tetrahydroquinoline compound.

19. A material according to claim 1, wherein the condensation component (B) is a member selected from the group consisting of a 5-pyrazolone compound, a cresidine, phenetidine or N,N-di(lower alkyl)aniline compound, a 3-(lower alkyl)-6-di(lower alkyl)aminoindole compound, 2-(lower alkyl)indole, 2-phenylindole, a 3-(lower alkyl)-6-(lower alkoxy)indole compound or an N-$C_1$–$C_8$alkyl-substituted 2-(lower alkyl)indole, 2-phenylindole, 3-(lower alkyl)-6-(lower alkoxy)indole and 3-(lower alkyl)-6-di(lower alkyl)aminoindole compound.

20. A material according to claim 1, wherein the condensation component (B) is a fluoran or phthalide compound which has at least one unsubstituted or lower alkyl-, cyclohexyl-or benzyl-monosubstituted amino group.

21. A material according to claim 1, wherein the colour-developing component (C) is a member selected from the group consisting of a Lewis acid, an acid clay, a solid carboxylic acid and a compound having a phenolic hydroxyl group.

22. A material according to claim 1, wherein the colour-developing component (C) is an active clay or a zinc salicylate.

23. A material according to claim 1, wherein component (A) or (B) on the first sheet is dissolved in an organic solvent.

24. A material according to claim 23, wherein the first sheet is a transfer sheet.

25. A material according to claim 23, wherein the dissolved component (A) or (B) is microencapsulated.

26. A material according to claim 25, wherein component (A) is encapsulated and is present in the form of a layer on the back of the first sheet.

27. A material according to claim 26, wherein the first sheet is a transfer sheet.

28. A material according to claim 25, wherein component (B) is encapsulated and is present in the form of a layer on the back of the first sheet.

29. A material according to claim 28, wherein the first sheet is a transfer sheet.

30. A material according to claim 1, wherein (A) and (B) are present together with one or more conventional colour formers.

31. A material according to claim 30, wherein the conventional colour former is a member selected from the group consisting of 3,3-(bisaminophenyl)phthalides, 3-indolyl-3-aminophenylaza- and -diaza-phthalides, (3,3-bisindolyl)phthalides, 3-aminofluorans, 6-dialkylamino-2-dibenzylaminofluorans, 6-dialkylamino-3-methyl-2-arylaminofluorans, 3,6-bisalkoxyfluorans, 3,6-bisdiarylaminofluorans, leucoauramines, spiropyrans, spirodipyrans, chromenopyrazoles, chromenoindoles, benzoxazines, phenoxazines, phenothiazines, quinazolines, rhodamine lactams, carbazolylmethanes and triarylmethanes.

32. A material according to claim 1 wherein the back of the first sheet has been coated with encapsulated solvent for components (A) and (B) and the second sheet has been coated on its surface with components (A), (B) and (C).

33. A material according to claim 32, wherein component (C) is an active clay or a zinc salicylate.

34. A material according to claim 32, wherein the first sheet is a base sheet.

* * * * *